US005836247A

United States Patent [19]

Stephan et al.

[11] Patent Number: 5,836,247

[45] Date of Patent: Nov. 17, 1998

[54] CONTACT-FREE SHEET GUIDANCE DEVICE IN A SHEET-FED PRINTING PRESS

[75] Inventors: Günter Stephan, Wiesloch-Baiertal; Peter Thoma, Mannheim, both of Germany

[73] Assignee: Heidelberger Druckmaschinen AG, Heidelberg, Germany

[21] Appl. No.: 922,423

[22] Filed: Sep. 3, 1997

[30] Foreign Application Priority Data

Sep. 3, 1996 [DE] Germany ..... 296 15 295.1
May 22, 1997 [DE] Germany ..... 197 21 390.1

[51] Int. Cl.[6] ..... B41F 1/28

[52] U.S. Cl. ..... 101/420; 101/416.1; 271/194; 271/195

[58] Field of Search ..... 101/420, 416.1, 101/419, 232, 240; 271/194, 195

[56] References Cited

U.S. PATENT DOCUMENTS

| | | | |
|---|---|---|---|
| 3,231,165 | 1/1966 | Wallin et al. | 242/615.11 |
| 3,633,281 | 1/1972 | Vits | 34/1 |
| 5,102,118 | 4/1992 | Vits | 271/195 |
| 5,156,090 | 10/1992 | Wirz | 101/142 |
| 5,398,925 | 3/1995 | Zeltner | 271/276 |

FOREIGN PATENT DOCUMENTS

| | | | |
|---|---|---|---|
| 1 449 656 | 11/1968 | Germany . | |
| 19 07 083 | 9/1970 | Germany . | |
| 28 02 610 C2 | 7/1979 | Germany . | |
| 32 34 155 A1 | 3/1984 | Germany . | |
| 40 39 311 C2 | 6/1992 | Germany . | |
| 42 09 067 A1 | 9/1993 | Germany . | |
| 42 17 813 C2 | 12/1993 | Germany . | |
| 195 45 799 C1 | 1/1997 | Germany . | |
| 195 30 039 A1 | 2/1997 | Germany . | |
| 196 38 311 A1 | 5/1997 | Germany . | |
| 0583059 | 12/1977 | U.S.S.R. | 271/195 |
| 0933582 | 6/1982 | U.S.S.R. | 271/194 |
| 2255079 | 10/1992 | United Kingdom | 271/195 |
| 2276150 | 9/1994 | United Kingdom | 271/195 |

OTHER PUBLICATIONS

Schell, Pneumatic (Angled jets) Bottom Feeder, Xerox Disclosure Journal, vol. 6 No. 5, p. 235, Sep., Oct. 1981.

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

A contact-free sheet guidance device in a sheet-fed printing press, having a sheet guiding surface, includes at least one blast air nozzle formed in the sheet guiding surface and having a cross section directed obliquely downwardly with respect to the sheet guiding surface, the sheet guiding surface being formed with an opening for an air outlet directed substantially vertically at a sheet being fed in the sheet travel direction, the air outlet opening being disposed upstream of the blast air nozzle in the sheet travel direction and being smaller in cross section than the cross section of the blast air nozzle.

4 Claims, 1 Drawing Sheet

CONTACT-FREE SHEET GUIDANCE DEVICE IN A SHEET-FED PRINTING PRESS

BACKGROUND OF THE INVENTION

Field of the Invention

The invention relates to a device for contact-free sheet guidance in a sheet-fed printing press and, more particularly, to such a sheet guidance device having a sheet guiding surface, wherein there is provided at least one blast air nozzle having a cross section directed obliquely downwardly with respect to the sheet guiding surface.

A sheet guidance device of this general type has become known heretofore from German Patent 19 07 083 wherein, in a guide baffle, blast air nozzles having a cross section in the form of a sector of a ring slot are provided in a surface of the guide baffle, and an air guiding surface is formed extending obliquely downwardly relative to the surface of the guide baffle, and defining the ring slot sector which is located opposite to the air guiding surface. The blast air nozzles of the conventional device shown in the German patent are provided with a guide baffle formed with punched or stamped-out tonguelike notches for producing a directionally focused airflow, with a shallow angle directed in the sheet-feeding direction towards the sheet to be transported which floats above the surface of the guide baffle. A geometrical bottleneck for the air flowing through the respective blast air nozzle is located at an air outlet location. This choke point is followed by a diverging guide surface acting as a diffuser and, in this region, a negative pressure typical for a diffuser is generated which sucks the sheet against the guide face formed by the tonguelike notches. Due to this suction, contact-free sheet guidance is no longer achieved. Consequences thereof are the occurrence of scratches, and smearing of the side of the sheet communicating with the guidance device. Comparable with the foregoing conventional device is the action of a device heretofore known from the published German Patent Document DE 41 13 465 A1.

SUMMARY OF THE INVENTION

It is accordingly an object of the invention to provide a contact-free sheet guidance device in a sheet-fed printing press with blast air nozzles having the features referred to in the introduction hereto so that the emerging blast or blown air does not have any negative pressure zones which would otherwise disrupt uniform air flow under the sheet to be fed, and consequently assures contact-free sheet guidance.

With the foregoing and other objects in view, there is provided, in accordance with the invention, a contact-free sheet guidance device in a sheet-fed printing press, having a sheet guiding surface, comprising at least one blast air nozzle formed in the sheet guiding surface and having a cross section directed obliquely downwardly with respect to the sheet guiding surface, the sheet guiding surface being formed with an opening for an air outlet directed substantially vertically at a sheet being fed in the sheet travel direction, the air outlet opening being disposed upstream of the blast air nozzle in the sheet travel direction and being smaller in cross section than the cross section of the blast air nozzle.

In accordance with another feature of the invention, the sheet guiding surface is formed on a guide plate wherein the blast air nozzle is disposed, the blast air nozzle having an outlet profile formed, in plan view, of a ring slot sector, the ring slot sector having a center of curvature at which a small opening is formed in the guide plate as an outlet for blast air.

In accordance with a further feature of the invention, the blast air nozzle is disposed so that blast air emerging therefrom is in a given flow direction enclosing with the sheet guiding surface an angle having a vertex directed in the sheet travel direction.

In accordance with a concomitant feature of the invention, the blast air nozzle is formed by an incision in the guide plate and by deformation of the air guiding surface in the vicinity of the incision.

Thus, with the opening having a smaller cross section than that of the blast air nozzle, air is additionally blown under the sheet in the immediate vicinity of the negative pressure region resulting from the diffusor action of the blast air nozzle, so that the sheet is forced away, by an impulse force, from the area that would otherwise smear because of the negative pressure region. Smearing at this location is thereby averted.

Preferably, such an additional opening is provided in a blast air nozzle. The air flow emerging from the blast air nozzle encloses, together with the plane of the sheet, an angle having a vertex directed in the sheet feeding direction.

Other features which are considered as characteristic for the invention are set forth in the appended claims.

Although the invention is illustrated and described herein as embodied in a contact-free sheet guidance device in a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
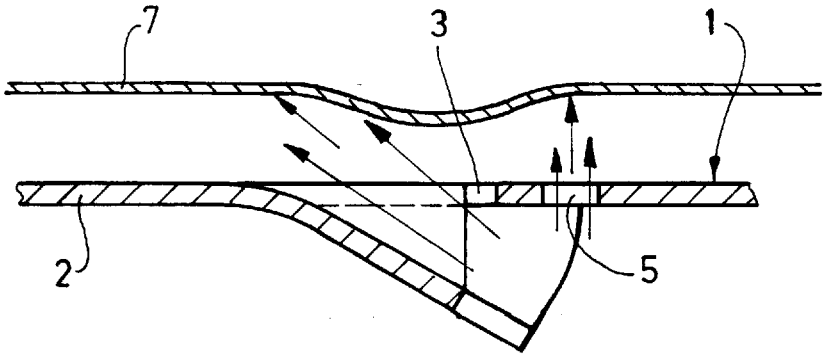
FIG. 1 is a sectional view of a blast air nozzle having an air guiding surface formed by recessing a tonguelike notch.

Referring now to the drawings and, first, particularly to FIG. 1 thereof, there is shown therein a sheet guiding surface 1 for contact-free guidance of a sheet 7 floating on an air cushion is formed by the surface of a guide plate 2. Mutually spaced-apart blast air nozzles 3, only one of which is illustrated in FIG. 1, are disposed in the guide plate 2, airblowing nozzles 3 are distributed over the sheet guiding surface 1. In the illustrated embodiment, each blast air nozzle 3 is formed by a tonguelike incision or notch 4 cut in the guide plate 2. The tongue created by the incision or notch 4 is depressed or deformed downwardly relative to the sheet guiding surface 1 and forms an air guiding surface which rises in the direction of sheet travel, i.e., from the right-hand side towards the left-hand side of FIG. 1.

Figure 2:
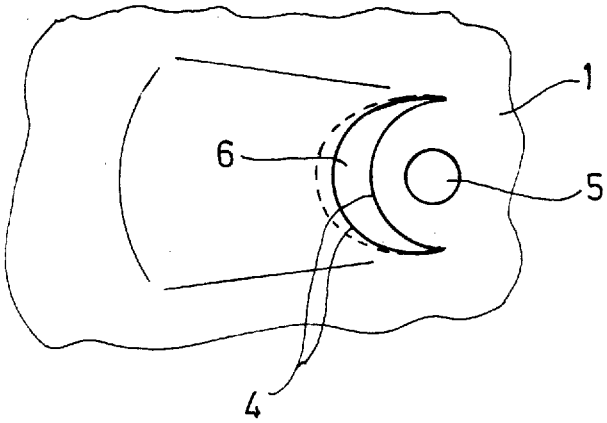
FIG. 2 is a fragmentary plan view of FIG. 1.

As shown in FIG. 2, the depressed portion of the guide plate 2 formed by the notch or incision has legs which diverge in the sheet travel direction and are joined together by an arc or other geometrical line in a preferred construction. This creates a blast air nozzle 3 in the form of an annular gap or ring slot sector 6. The notch 4 has a center of curvature located upstream of the annular gap or ring slot 6 of the blast air nozzle 3 and, formed in the guide plate 2 at the center of curvature is a small additional opening 5 from which air emerges additionally, compensating considerably for the negative pressure effect in the divergent region.

In the plan view of FIG. 2, it is believed to be clearly shown that the outlet profile of the blast air nozzle 3 appears as the annular gap or ring slot sector 6. The small opening 5, which is located at the center of curvature 7 of the annular gap or ring slot sector 6 and through which additional blast air emerges, is preferably directed vertically, or nearly vertically, at the sheet 7 from below. The cross section of the additional opening 5 and the cross-sectional profile thereof are preferably ascertained empirically to conform to given operating conditions. In adapting the small opening 5 to the shape of the annular gap or ring slot sector 6, the small opening 5 may also be provided with a different cross-sectional profile which deviates from a circular cross section.

In the vertical sectional plane parallel to the sheet travel direction through the center of the blast air nozzle 3, the tonguelike notch 4 may be provided with various different cross-sectional contours. To that end, the cross-sectional contour is adapted or conformed to various needs.

We claim:

1. A contact-free sheet guidance device in a sheet-fed printing press, having a sheet guiding surface, comprising at least one blast air nozzle formed in the sheet guiding surface and having a cross section directed obliquely downwardly with respect to the sheet guiding surface, the sheet guiding surface being formed with an opening for an air outlet directed substantially vertically at a sheet being fed in the sheet travel direction, said air outlet opening being disposed upstream of the blast air nozzle in the sheet travel direction and being smaller in cross section than the cross section of said blast air nozzle.

2. The sheet guidance device according to claim 1, wherein the sheet guiding surface is formed on a guide plate wherein said blast air nozzle is disposed, said blast air nozzle having an outlet profile formed, in plan view, of a ring slot sector, said ring slot sector having a center of curvature at which said opening is formed in said guide plate.

3. The sheet guidance device according to claim 1, wherein said blast air nozzle is disposed so that blast air emerging therefrom flows in a given flow direction enclosing with the sheet guiding surface an angle having a vertex directed in the sheet travel direction.

4. The sheet guidance device according to claim 2, wherein said blast air nozzle is formed by an incision in said guide plate and by deformation of the air guiding surface in the vicinity of said incision.

* * * * *